United States Patent [19]

Sauder

[11] 4,085,601

[45] Apr. 25, 1978

[54] NONPICKABLE LOCK

[76] Inventor: Kenneth D. Sauder, 1861 Brentwood Dr., Clearwater, Fla. 33516

[21] Appl. No.: 653,743

[22] Filed: Jan. 30, 1976

Related U.S. Application Data

[63] Continuation of Ser. No. 518,108, Oct. 25, 1974, abandoned.

[51] Int. Cl.[2] ..... E05B 29/02

[52] U.S. Cl. ..... 70/364 R; 70/377; 70/419

[58] Field of Search ..... 70/419, 421, 416, 364 R, 70/376, 377

[56] References Cited

U.S. PATENT DOCUMENTS

| | | | |
|---|---|---|---|
| 1,906,701 | 5/1933 | Mexwell | 70/421 |
| 1,965,889 | 7/1934 | Fitzgerald | 70/419 |
| 3,035,433 | 5/1962 | Testa | 70/364 R |

*Primary Examiner*—Robert L. Wolfe

*Attorney, Agent, or Firm*—Stein & Frijouf

[57] ABSTRACT

A nonpickable lock device comprising a housing, a plug rotably mounted in said housing and having an axially extending keyway, tumblers, disposed for reciprocal movement within cross bores formed in said plug for blocking rotation of said plug unless a properly bitted key is inserted in the keyway, and tumbler biasing means mounted in clearance slots formed in said plug in registry with said tumblers.

1 Claim, 2 Drawing Figures

NONPICKABLE LOCK

This application is a continuation of patent application Ser. No. 518,108, filed on Oct. 25, 1974, now abandoned.

BACKGROUND OF THE INVENTION

1. Field of the Invention

This invention relates to high security or nonpickable locks having a housing, a key plug rotably mounted in said housing, tumbler means for blocking rotation of said plug unless set at a predetermined position by insertion of a properly bitted key, and means designed to prevent picking of the lock device.

2. Description of the Prior Art

Locks in which a key plug is rotably mounted within a cylinder and which are released for rotation upon the setting of a series of tumblers in a predetermined position are well known. Furthermore, the problems associated with designing and manufacturing a nonpickable lock of this type have long been recognized by those skilled in the art.

Prior art devices intended to be nonpickable have been devised, but have not proved to be entirely functional. In some cases the locks have been so complex as to be incapable of being manufactured economically. In other cases the locks have become inoperative after only moderate use. Other supposedly nonpickable locks require the employment of keys of complex shapes, making duplication of the keys impossible with the equipment normally available to a locksmith. Most importantly, many of such locks have not proved to be nonpickable.

Because such problems are well known a number of nonpickable locks have been known in the art for some years. For example, U.S. Pat. No. 3,590,615 discloses an antipick lock. This apparatus utilizes lock pin tumblers equipped with one or more side pins, each of which is in cam relation to one or two tumblers so that the tumblers when moved by their spring pressure to a locking position will cause the side pins to project beyond a side of the key plug. Picking torque that may be applied to the key plug then will be transferred through the side pins to the cylinder. Also, a tumbler or coacting side pin alternately will move into a portion of the keyway during an attempt to pick the tumblers.

Another pickproof lock is disclosed in U.S. Pat. No. 3,455,130. That apparatus discloses pin tumblers in combination with a sidebar normally extending from the plug into a slot in the housing, thus preventing rotation of the plug. When a proper key is inserted into the keyway, the tumblers are configured so as to allow the side bar to move inwardly, allowing rotation of the lock. Each and every tumbler must be properly positioned in order for the side bar to release the plug.

Still another device, U.S. Pat. No. 2,295,737, discloses a pickproof lock utilizing a locking element for locking the key plug against rotation relative to the cylinder. The locking element locks the key plug against full rotation, while permitting some free rotation thereof. The locking element is mounted for movement to release the key plug for full rotation in the event that a series of tumblers are properly aligned by a key.

In addition to the device discussed above, a number of key operated cylinder locks have been developed. These devices generally comprise a housing, a cylinder having a keyway and a series of tumblers. No means specifically designed to prevent picking of these locks is disclosed.

Examination of the existing art reveals a number of pickproof locks. Unfortunately, many of these are extremely complex in that the antipick devices actually perform the function of blocking rotation of the cylinder. Many separate moving parts are required, each of which must be carefully machined and assembled if the lock is to work properly. Many of these locks, because of their complex construction, have not been able to withstand the rigors of prolonged, frequent usage. Still others have proved to be ineffective for their failure to provide a truly pickproof lock.

Thus, despite the large number of locks available, the conventional pickproof lock is generally costly in terms of manufacture and rate of failure.

SUMMARY OF THE INVENTION

This invention relates to a pick-proof lock which includes a lock plug rotably mounted in a housing and having an axially extending keyway. Tumbler means are arranged for reciprocal movement within cross bores formed in the lock plug and include bar blocking portions to block rotation of the lock plug. Tumbler biasing means are mounted in clearance slots in registry with the tumbler means so as to frustrate efforts to manipulate the tumblers to an unlocked position other than by insertion of a properly bitted key.

The lock of the present invention solves the problems existing in the prior art in that it comprises fewer mechanical parts than locks offering lesser security, thereby affording greater reliability while preserving simplicity of manufacture and operation.

More specifically, the device comprises a lock plug rotably mounted within the bore of a housing. Included in the lock plug is an axially extending keyway. A plurality of cross bores are formed in the plug and intersect the keyway. Mounted in the cross bores are tumbler means having bar blocking portions extendable into lock slots formed in the housing in registry with the cross bores when the device is in a locked position. The tumbler means are mounted for reciprocal movement and normally maintained in a locked position by tumbler spring means.

A plurality of clearance slots are also formed in the plug, extending inwardly from the periphery of the plug and intersecting the cross bores. Mounted in the clearance slots are tumbler biasing means in registry with the tumbler means and with tumbler biasing slots formed in the housing when the device is in a locked position. The tumbler biasing means are normally maintained in registry with the tumbler biasing spring means.

In the preferred embodiment of the device, two lock slots are formed in the housing in registry with each tumbler means in the locked position of the device. The tumbler means are of such a length and configuration as to block rotation of the plug by extending bar blocking portions into either of the two lock slots. Tumbler spring means normally cause only the lower bar blocking portion of the tumbler means to extend the lower of the two lock slots. Manipulation of the tumbler means by someone attempting to pick the lock would tend to raise the tumbler means so that the upper bar blocking portion thereof would extend into the upper of the two lock slots. The tumbler biasing means of this embodiment comprise a block having a rounded end extending outwardly of the clearance slot and a pin extending inwardly from the clearance slot. The pin of the tumbler biasing means is in registry with the tumbler means and is maintained in that position by tumbler biasing spring means. The tumbler biasing means provide the anti-pick feature of the device. Because of the frictional forces generated at the point of intersection of the tumbler biasing means and the tumbler means, when someone attempts to manipulate the tumbler means to an unlocked position other than by use of a properly bitted key, the sensitivity of touch necessary to so position a tumbler is lost. It is obvious that such a loss of sensitivity may be enhanced by providing that portion of the tumbler means registering with the tumbler biasing means with a roughened or grooved surface. The block of the tumbler biasing means is rounded as is the corresponding tumbler biasing slot. This configuration allows the tumbler biasing means to move within the plug when the tumbler means are aligned in an unlocked position and the plug is rotated. In order to unlock the device, each and every tumbler means must be supported at a predetermined height within the plug so that no bar blocking portions extend into any lock slots.

In another embodiment of the device a single lock slot is formed in the housing in registry with each tumbler means in the locked position of the device. The lock slots further comprise grooves formed in the housing and extending circumferentially about the periphery of the plug. The bar blocking portions of the tumbler means include tongues formed on the ends thereof in corresponding relation to the grooves when the device is in the unlocked position. Tumbler spring means normally cause the bar blocking portions of the tumbler means to extend into the lock slots in the locked position of the device. The tumbler biasing means of this embodiment comprise springs. As previously described, the tumbler biasing means provide the anti-pick feature of the device. The tumbler biasing means are provided with rounded tips in corresponding relation to rounded tumbler biasing slots to allow the tumbler biasing means to move within the plug when the tumbler means are aligned in an unlocked position and the plug is rotated. In order to unlock the device each and every tumbler means must be supported at a predetermined height within the plug so that no bar blocking tongue fails to match its correspondingly configured groove in the lock slots.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 2:
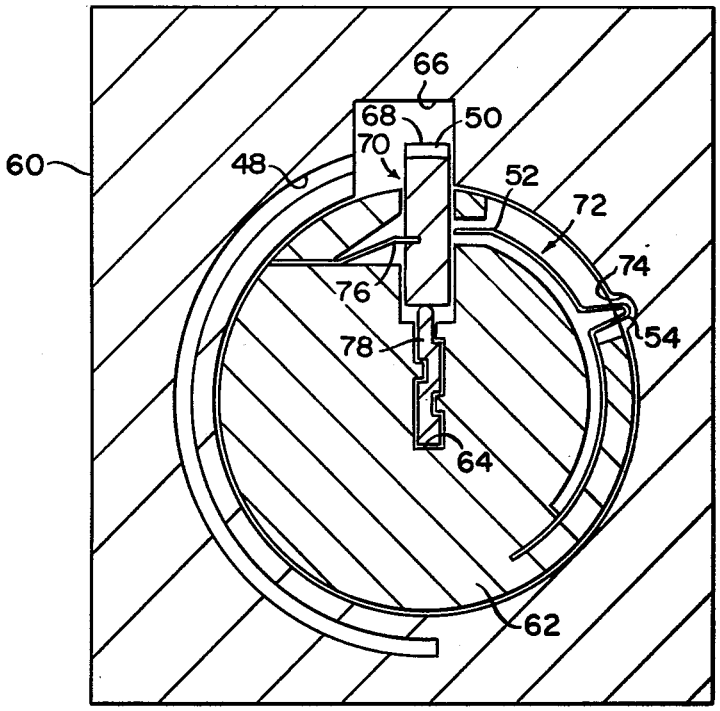
FIG. 2 is a front cross-sectional view similar to FIG. 1 showing a modified form of a device in accordance with the invention.

This invention relates to a pickproof lock device comprising a housing 10 having a bore 12. Rotably mounted within bore 12 is a plug 14 having an axially extending keyway 16. A plurality of cross bores 18 are formed in plug 14 at least one of which intersects keyway 16. A plurality of clearance slots 20 extend inwardly from the periphery of plug 14 and intersect cross bores 18. A plurality of lock slots 22 are formed in housing 10 in registry with cross bores 18 in the locked position of the device. The device further includes a plurality of tumbler biasing slots 24 formed in housing 10 in registry with clearance slots 20 in the locked position of the device. Mounted for reciprocal movement in cross bores 18 are tumbler means generally indicated as 26 comprising upper bar blocking portions 28', lower bar blocking portions 28 and tumbler spring means 30. Mounted in clearance slots 20 are tumbler biasing means generally indicated as 32.

Figure 1:
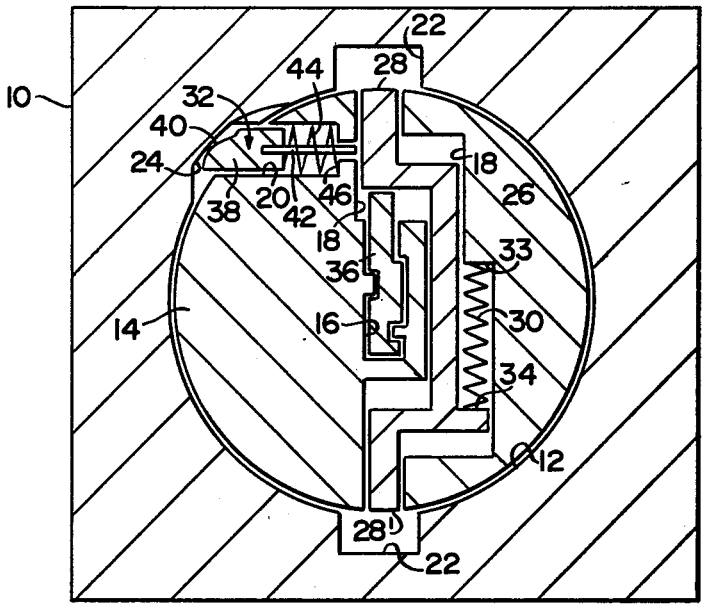
FIG. 1 is a front cross-sectional view of the device in accordance with the invention.

As best seen in FIG. 1, two lock slots 22 are formed in housing 10 in registry with cross bores 18 in the locked position of the device. Tumbler means 26 are of such length as to block rotation of plug 14 by extending bar blocking portions 28 and 28' into either of two lock slots 22. Tumbler spring means 30 are disposed within cross bores 18 interposed between a wall 33 of cross bore 18 and a lip 34 of tumbler means 26. The outward biasing force of tumbler spring means 30 normally extends lower bar blocking portion 28' into lock slot 22 in the locked position of the device. The inward biasing force of a key 36 exceeds the outward biasing force of tumbler spring means 30 when key 36 is inserted in keyway 16. Tumbler biasing means 32 comprise a block 38 having a rounded end 40 extending outwardly of clearance slot 20 and pin 42 extending inwardly from clearance slot 20. Tumbler biasing means 32 are disposed within clearance slots 20 in registry with tumbler means 26 and tumbler biasing slots 24 in the locked position of the device and are maintained in such position by tumbler biasing spring means 44 interposed between block 38 and wall 46 of clearance slot 20. Block 40 is rounded as is the corresponding tumbler biasing slot 24 to allow tumbler biasing means 32 to move within plug 14 when tumbler means 26 are aligned in an unlocked position and plug 14 is rotated. Because of the frictional forces generated at the point of intersection of tumbler biasing means pin 42 and tumbler means 26, when someone attempts to manipulate tumbler means 26 to an unlocked position other than by use of a properly bitted key 36, the sensitivity of touch necessary to so position bar blocking portions 28 and 28' is lost.

As best seen in FIG. 2, the device may include a single lock slot 66 formed in housing 60 is registry with each tumbler means 70 in the locked position of the device. Lock slots 66 comprise grooves 48 formed in housing 60 and extending circumferentially about the periphery of plug 62. Bar blocking portions 68 include tongues 50 formed on the end thereof in corresponding relation to grooves 48 when the device is in the unlocked position. The outward biasing force of key 78 exceeds the inward biasing force of tumbler spring 76 when key 78 is inserted in keyway 64. Side bar biasing means 72 comprise a spring 52 having formed therein a rounded tip 54 in corresponding relation to tumbler biasing slot 74 to allow side bar biasing means 72 to move within plug 62 when tumbler means 70 are aligned in an unlocked position and plug 62 is rotated.

In order to unlock the device each and every tumbler means 26 must be supported at a predetermined height within plug 14 so that no bar blocking portions 28 and 28' extend into any lock slots 22 in other than an unlocked position. Known picking techniques involve the application of a lateral force against the tumblers and the simultaneous raising and lowering of the tumblers. The lateral force enables the picker to hang the tumblers at the predetermined height to which the tumblers would be raised by a properly bitted key. Obviously, such techniques require a high degree of sensitivity of touch when manipulating the tumblers. The present invention frustrates such techniques by eliminating the required sensitivity of touch. The tumbler biasing means 32 bind against the tumbler means 26 thereby creating meaningless vibrations as the picker raises and lowers tumbler means 26. It should also be emphasized that in order to unlock the device each individual tumbler means 32 must be supported at a predetermined height.

It will thus be seen that the objects made apparent from the preceding description are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A lock comprising a housing having a bore formed therein; a cylindrical lock plug rotatably mounted within said bore, said plug having an axially extending keyway formed therein; a plurality of cross bores formed in said plug in communicating relation to said keyway; a corresponding plurality of clearance slots extending inwardly from the periphery of said plug and perpendicularly intersecting said cross bores; a plurality of lock slots formed in said housing each one being in registry with a corresponding end of one of said plurality of cross bores in the locked position of said lock; a corresponding plurality of tumbler biasing slots formed in said housing, each of said tumbler biasing slots being formed in communicating relation to a corresponding one of said clearance slots in the locked position of said lock; a corresponding plurality of tumbler means, said plurality of said tumbler means being respectively mounted for reciprocal movement in said plurality of cross bores; each of said tumbler means including one bar blocking portion on one end thereof; a plurality of tumbler spring means interposed between said plug and said plurality of tumbler means for yieldably shifting said plurality of tumbler means in said cross bores to normally extend said bar blocking portion of each of said plurality of tumbler means into a corresponding one of said lock slots in the locked position of said lock; said bar blocking portions comprising a tongue with each of said lock slots further comprising a circumferentially extending groove dimensioned to matingly receive a corresponding one of said tongues in the unlocked position of said lock, said tumbler means being of such length as to block rotation of said plug by extending said bar blocking portions into said lock slots, said tumbler spring means comprising a plurality of leaf springs interposed between said plurality of tumbler means and said plug whereby the outward biasing force of a key exceeds the inward biasing force of said tumbler spring means when a key is inserted in said keyway, side bar biasing spring means comprising a leaf springs movably mounted in each of said clearance slots and cooperating with said tumbler means and said tumbler biasing slot to project one end of said side bar biasing spring means into contact with a corresponding one of said tumbler means to prevent movement thereof upon rotation of said plug, said side bar biasing spring means having a first end mounted to said plug and having a second end for contacting said tumbler means, said first end of said side bar biasing spring means being receivable within a slot within said cylindrical lock plug; and said side bar biasing spring means having a projecting tip portion interposed between said first and second ends for cooperation with the wall of said tumbler biasing slot upon movement of the spring.

* * * * *